US007793357B2

(12) United States Patent
Peng et al.

(10) Patent No.: US 7,793,357 B2
(45) Date of Patent: Sep. 7, 2010

(54) METHOD OF PRODUCING ULTRA THIN CHITOSAN FIBERS AND NON-WOVEN FABRICS

(75) Inventors: Chao-Chun Peng, Hsinchu (TW); Tzu-Hsiang Huang, Taipei (TW); Jian-Min Lin, Benchiao (TW); Jen-Hsiung Lee, Panchiao (TW)

(73) Assignee: Taiwan Textile Research Institute, Tu-Chen, Taipei Hsien (TW)

( * ) Notice: Subject to any disclaimer, the term of this patent is extended or adjusted under 35 U.S.C. 154(b) by 992 days.

(21) Appl. No.: 11/540,887

(22) Filed: Sep. 29, 2006

(65) Prior Publication Data

US 2007/0145627 A1 Jun. 28, 2007

(30) Foreign Application Priority Data

Dec. 28, 2005 (TW) ..... 94147074 A

(51) Int. Cl.

| | |
|---|---|
| ***D01D 1/10*** | (2006.01) |
| ***D01D 5/098*** | (2006.01) |
| ***D01F 4/00*** | (2006.01) |
| ***D04H 3/02*** | (2006.01) |

(52) U.S. Cl. ..... 264/555; 264/103; 264/169; 264/180; 264/202; 264/178 F; 264/210.3; 264/210.8; 264/211.15; 264/211.16

(58) Field of Classification Search ..... 264/103, 264/180, 202, 178 F, 210.3, 210.8, 211.14, 264/211.15, 211.16, 555, 169
See application file for complete search history.

(56) References Cited

U.S. PATENT DOCUMENTS 4,963,298 A * 10/1990 Allen et al. ..... 264/180 X
5,622,666 A * 4/1997 Struszczyk et al. ..... 264/191

* cited by examiner

*Primary Examiner*—Leo B Tentoni
(74) *Attorney, Agent, or Firm*—Thomas, Kayden, Horstemeyer & Risley, LLP

(57) ABSTRACT

This invention provides a method of producing chitosan non-woven fabrics and an apparatus thereof. At first, a chitosan acidic solution is extruded to form a chitosan fibrous stream. Then, a solidifying agent is ejected to form a solidifying agent stream. The solidifying agent stream and the chitosan fibrous stream are combined to form a pre-solidified chitosan fiber. Then, high-pressure air is ejected on the pre-solidified chitosan fiber to stretch the pre-solidified chitosan fiber. Finally, the chitosan fibers are collected to form chitosan non-woven fabrics.

6 Claims, 1 Drawing Sheet

METHOD OF PRODUCING ULTRA THIN CHITOSAN FIBERS AND NON-WOVEN FABRICS

RELATED APPLICATIONS

The present application is based on, and claims priority from, Taiwan Application Serial Number 94147074, filed Dec. 28, 2005, the disclosure of which is hereby incorporated by reference herein in its entirety.

BACKGROUND

1. Field of Invention

The present invention relates to a method of producing chitosan non-woven fabrics and an apparatus thereof. More particularly, the present invention relates to a method of producing ultra fine fibers of chitosan non-woven fabrics and an apparatus thereof.

2. Description of Related Art

Because chitosan is a natural material, chitosan non-woven fabrics have properties and advantages that are unique to the natural material. For example, chitosan non-woven fabrics are very comfortable to wear, easily decomposed and absorbed by organisms, and very hygroscopic. In the medical field, several products, such as absorbable sutures, artificial skin and wound dressings, have been developed using the decomposition and absorption properties of the natural chitosan. Moreover, the highly hygroscopic property of chitosan can be applied to sanitary products such as wipe papers.

Traditional methods of producing chitosan non-woven fabrics includes a paper method, a needle punching method, a water needle method and an electrospinning method. In the paper method, chitosan fibers are dispersed in water and then through a net to form the shape of the chitosan non-woven fabrics. To complete the manufacturing of the chitosan non-woven fabrics, the chitosan fibers are dried by baking. The production speed of the paper method is very fast, and thus large quantities of chitosan non-woven fabrics can be manufactured. However, the chitosan non-woven fabrics made by the paper method are not soft and therefore have a bad feeling. The needle punching method improves on the disadvantages of the paper method. The chitosan non-woven fabrics made by the needle punching method are soft, highly hygroscopic, ventilated and easy to store. However, the cost of the needle punching method is high and the strength of the chitosan non-woven fabrics made by the needle punching method is weak. Moreover, both the paper method and the needle punching method need after-treatments to meet the demands of non-woven fabrics. The water needle method doesn't need after-treatment. The chitosan non-woven fabrics made by the water needle method have a good touch feeling. However, the water needle method consumes a lot of energy. The production cost of the water needle method is thus very high. The electrospinning method is a new technology, which is not mature enough and thus there are many technological bottlenecks need to be solved.

SUMMARY

It is therefore an aspect of the present invention to provide a method of producing chitosan non-woven fabrics. The fibers produced by this method can be ultra thin. The fibers are so thin that they achieve micrometer scales. Moreover, the non-woven fabrics produced by this method have a good feeling and are highly hygroscopic, ventilated and easy to store.

Another aspect of the present invention is to provide a method of producing chitosan non-woven fabrics. The method is simple. The method doesn't need after-treatments. The production cost of the method is cheap.

In accordance with the foregoing aspects, one embodiment of the present invention provides a method of producing chitosan non-woven fabrics.

Firstly, chitosan is dissolved in an acidic solution to form a chitosan acidic solution. Secondly, the chitosan acidic solution is extruded to form a chitosan fibrous stream. Thirdly, a solidifying agent is ejected to form a solidifying agent stream. Fourthly, the chitosan fibrous stream and the solidifying agent stream are combined to form a pre-solidified chitosan fiber, wherein the chitosan fibrous stream and the solidifying agent flow form a non-zero first angle. Fifthly, a high-pressure air is ejected on the pre-solidified chitosan fiber to stretch it, wherein the high-pressure air and the pre-solidified chitosan fiber form a non-zero second angle. Finally, the chitosan fiber is collected to form chitosan non-woven fabrics.

In accordance with the foregoing aspects, one embodiment of the present invention provides an apparatus of producing chitosan non-woven fabrics. The apparatus comprises a raw material provider, a spinning nozzle and a collecting apparatus. The spinning nozzle comprises a raw material nozzle, a solidifying agent nozzle and a high-pressure nozzle. The solidifying agent nozzle is positioned around the raw material nozzle. The solidifying agent jet and the raw material nozzle form a non-zero first angle. The high-pressure nozzle is positioned around the solidifying agent nozzle. The high-pressure nozzle and the raw material nozzle form a non-zero second angle. The raw material provider provides a chitosan acidic solution. The raw material nozzle extrudes the chitosan acidic solution. The solidifying agent nozzle ejects a solidifying agent jet to solidify the chitosan acidic solution to a fiber. The high-pressure nozzle ejects a high-pressure air to stretch the fiber. The collecting apparatus collects the fiber to form chitosan non-woven fabrics.

In accordance with the foregoing aspects, one embodiment of the present invention provides a spinning nozzle. The spinning nozzle comprises a raw material nozzle, a solidifying agent nozzle and a high-pressure nozzle. The solidifying agent nozzle is positioned around the raw material nozzle. The solidifying agent nozzle and the raw material nozzle form a non-zero first angle. The high-pressure nozzle is positioned around the solidifying agent nozzle. The high-pressure nozzle and the raw material nozzle form a non-zero second angle. The raw material nozzle extrudes a chitosan acidic solution. The solidifying agent nozzle ejects a solidifying agent stream to solidify the chitosan acidic solution to a fiber. The high-pressure nozzle ejects a high-pressure air to stretch the fiber.

In conclusion, the spinning nozzle of the invention can simultaneously extrude the chitosan acidic solution, the solidifying agent and the high-pressure air. Therefore, the spinning nozzle can form the pre-solidified chitosan fiber and stretch it at the same time. The non-woven fabrics made by the apparatus have a good feeling, are highly hygroscopic, ventilated and easy to store. Moreover, the manufacturing processes of the raw material extrusion, fiber solidification and fiber stretching are integrated in one nozzle system. The manufacture processes become simpler and the production cost is cheaper.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENTS

Figure 1:
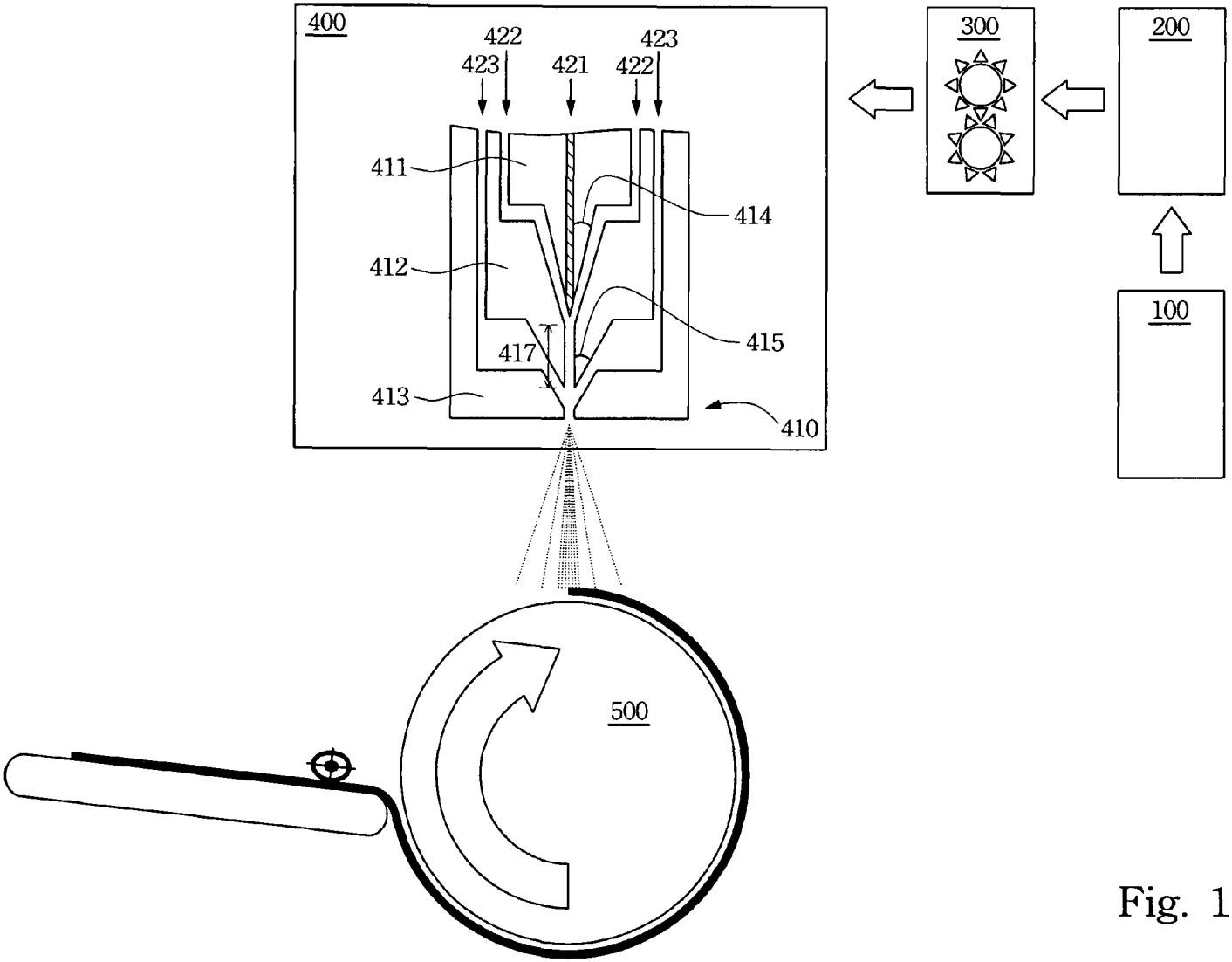
FIG. 1 is an apparatus of producing chitosan non-woven fabrics in one preferred embodiment of the invention.

FIG. 1 is an apparatus of producing chitosan non-woven fabrics in one preferred embodiment of the invention. In FIG. 1, the apparatus comprises a raw material provider 100, a filter 200, a pump 300, a spinning nozzle head 400 and a collecting apparatus 500. The spinning nozzle head 400 comprises at least a spinning nozzle 410. Each spinning nozzle 410 comprises a raw material nozzle 411, a solidifying agent nozzle 412 and a high-pressure nozzle 413. The solidifying agent nozzle 412 is positioned around the raw material nozzle 411. The solidifying agent nozzle 412 and the raw material nozzle 411 form a non-zero first angle 414. The first angle is less than 90°. In a preferred embodiment, the first angle is 30°, 45° or 60°. The high-pressure nozzle 413 concentrically is positioned around the solidifying agent nozzle 412. The high-pressure nozzle 413 and the raw material nozzle 411 form a non-zero second angle 415. The second angle is less than 90°. In a preferred embodiment, the second angle is 30°, 45° or 60°.

At fist, the raw material provider 100 provides a chitosan acidic solution 421. The filter 200 will filter the chitosan acidic solution 421. The pump 300 provides pressure for the chitosan acidic solution 421 to be extruded from the raw material provider 411. The raw material nozzle 411 extrudes the chitosan acidic solution 421 to form a chitosan fibrous stream. The solidifying agent nozzle 412 ejects a solidifying agent stream. The solidifying agent stream will combine with the chitosan fibrous stream at the first angle 414 to solidify the chitosan fibrous stream to form a fiber. The high-pressure nozzle 413 ejects a high-pressure air 423. The high-pressure air 423 will combine with the fiber at the second angle 415 to stretch the fiber. The collecting apparatus 500 collects the fiber to form non-woven fabrics. In FIG. 1, the collecting apparatus 500 is a collecting roller, however, the collecting apparatus 500 is not limited to the collecting roller and can be other types of collecting apparatuses in the invention.

The chitosan acidic solution 412 is made by dissolving chitosan in an acidic solution. In a preferred embodiment, the acidic solution is an acetic acidic solution. The weight percentage concentration of the acetic acid is about 1.5%~2.5%. Chitosan with molecular weight ranging from $1*10^5$ to $3*10^5$ is dissolved in the acetic acid to form the chitosan acidic solution 421. The weight percentage concentration of the chitosan acidic solution 421 is preferably about 3%~5%, more preferably about 4.5%. The solidifying agent 422 is a base solution and it can solidify the chitosan acidic solution 421, which is extruded by the raw material provider 411, into fibers. In a preferred embodiment, the solidifying agent is sodium hydroxide solution. The concentration of the sodium hydroxide solution is 0.1% to 10%.

The length 417 of the solidifying agent nozzle 412 will influence the solidified degree and the solidified time of pre-solidified chitosan fibers. The longer the length 417 of the solidifying agent nozzle 412 is, the longer time the pre-solidified chitosan fibers need to be solidified. The pre-solidified chitosan fibers are hardly to stretch to longer and thinner with long length 417 of the solidifying agent nozzle 412. In a preferred embodiment, the length 417 of the solidifying agent nozzle 417 is about 6~40 mm. Moreover, the first angle 414, which the solidifying agent stream and the chitosan fibrous stream combine at, is very important because the first angle 414 will influence the solidified degree of the pre-solidified chitosan fiber and further influence the following step of stretching the pre-solidified chitosan fiber. The pressure range of the high pressure 423 ejected by the high-pressure nozzle 413 is about 5~25 psi. The temperature range of the high pressure 423 is about 0~100° C. The second angle 413, which the high pressure 423 and the pre-solidified chitosan fiber combine at, is also very important because the angle will influence the thinness of the final fiber. The diameters of chitosan fibers produced by the apparatus of chitosan non-woven fabrics of the invention are smaller than 10 μm and are in micrometer scale.

Accordingly, the present invention has the following advantages.

(1) The manufacturing processes of the raw material extrusion, fiber solidification and fiber stretching are integrated into one nozzle system. The manufacture processes become simpler and the production cost is cheaper.

(2) The fibers produced by this method can be ultra thin. The fibers are so thin that they can achieve micrometer scales.

(3) The non-woven fabrics made by the apparatus feel good, are highly hygroscopic, ventilated and easy to store.

The preferred embodiments of the present invention described above should not be regarded as limitations to the present invention. It will be apparent to those skilled in the art that various modifications and variations can be made to the present invention without departing from the scope or spirit of the invention. The scope of the present invention is defined in the appended claims.

What is claimed is:

1. A method of producing chitosan non-woven fabrics, comprising in sequence:

dissolving chitosan in an acidic solution to form a chitosan acidic solution;

extruding the chitosan acidic solution to form a chitosan fibrous stream;

ejecting a solidifying agent to form a solidifying agent stream;

combining the chitosan fibrous stream and the solidifying agent stream to form at least one pre-solidified chitosan fiber, wherein the chitosan fibrous stream and the solidifying agent flow forms a non-zero first angle that is less than 90°;

ejecting a high-pressure air on the pre-solidified chitosan fiber to stretch the chitosan fiber, wherein the high-pressure air and the pre-solidified chitosan fiber form a non-zero second angle that is less than 90°; and collecting the chitosan fiber to form chitosan non-woven fabrics.

2. The method of claim 1, wherein the solidifying agent is a base solution.

3. The method of claim 1, wherein the solidifying agent is a solution of sodium hydroxide.

4. The method of claim 1, wherein the pressure range of the high-pressure air is about 1~20 psi.

5. The method of claim 1, wherein the temperature range of the high-pressure air is about 1~100° C.

6. The method of claim 1, further comprising filtering the chitosan acidic solution before the step of extruding the chitosan acidic solution.

* * * * *